United States Patent [19]

Saito

[11] Patent Number: 4,926,011

[45] Date of Patent: May 15, 1990

[54] MULTIOBJECTIVE SWITCH OPENING AND CLOSING APPARATUS

[76] Inventor: Takashi Saito, 29-4, Kumano-chyo, Itabashi-ku, Tokyo, Parkside Mansion 302, Japan

[21] Appl. No.: 279,951

[22] Filed: Dec. 5, 1988

[51] Int. Cl.[5] ..... H01H 25/04

[52] U.S. Cl. ..... 200/6 A

[58] Field of Search ..... 200/4, 5 R, 6 A, 17 R, 200/18

[56] References Cited

U.S. PATENT DOCUMENTS

| | | | |
|---|---|---|---|
| 2,841,659 | 7/1958 | Eitel | 200/6 A |
| 3,293,381 | 12/1966 | Eitel | 200/6 A |
| 4,245,137 | 1/1981 | Hirai et al. | 200/6 A X |
| 4,749,826 | 6/1988 | Saito | 200/6 A |
| 4,816,622 | 3/1989 | Holloway | 200/6 A |

*Primary Examiner*—J. R. Scott

*Attorney, Agent, or Firm*—Notaro & Michalos

[57] ABSTRACT

This invention relates to a multiobjective switch opening and closing apparatus which is suitable for use, for example, with a television game machine, comprising a support plate, a guide plate with a guide hole mounted parallel to the support plate, an operating lever mounted pivotably and rotatably on the support plate and reaching the guide hole, a plurality of first switches positioned between the support plate and the guide plate and installed around the operating lever, and a plurality of second switches positioned between the first switches and the support plate and installed around the operating lever. The opening and closing of the first switches are selectively carried out by the pivotal operation of the operating lever whereas the opening and closing of the second switches are selectively carried out by the rotational operation thereof, whereby the opening and closing of a number of switches can be carried out by operating a single operating lever. One or two of the first and second switches can be opened and closed simultaneously.

6 Claims, 6 Drawing Sheets

MULTIOBJECTIVE SWITCH OPENING AND CLOSING APPARATUS

BACKGROUND OF THE INVENTION

1. Field of the Invention

This invention relates to a multiobjective switch opening and closing apparatus in which a number of switches can be opened and closed by a single operating lever and which is particularly suitable for use with a television game machine.

2. Description of the Prior Art

The television game machine comprises, as shown in FIG. 7, a body 1 provided with a display device 1*a* for displaying the content of a game and a control unit 2 for varying the teleview of the display device 1*a*.

The control unit 2 has a casing 3 mounted on the body 1, a switch opening and closing apparatus 4 partly accommodated within the casing 3 and mounted on the casing 3 to control action of a character comprising a human figure and a thing appearing on the faceplate of the display device 1*a*, and a switch 5 for operating the discontinuance of the game and so forth.

The switch opening and clsoing apparatus 4 comprises, as shown in FIG. 8, a support plate 6, a case body 7 fixedly mounted on the support plate 6 through mounting screws 7*a*, 7*a*, a guide plate 8 mounted on the case 7 through mounting screws 8*a*, 8*a*, an operating lever 9 swingably and pivotally mounted on the support plate 6 and extending via a guide hole 8*b* of the guide plate 8, and a number of automatic-return switches 9*c* such as microswitches arranged between the support plate 6 and the guide plate 8 and surrounding a switch press portion 9*a* of the operation lever 9.

According to this switch opening and closing apparatus 4, switch activators 9*b* fo the switches 9*c* are operated by the reception of the pivotal force of the switch press portion 9*a* of the operating lever 9 to be pivotally moved, and various parts of a character on the faceplate are operated in response to the operation of the switches. The guide hole 8*b* of the guide plate 8 guides the operating lever 9 towards the activators 9*b* whereby the switches 9*c* are selectively operated.

With the popularization of the television game, games with complicated contents have been demanded, and accordingly, a switch opening and closing apparatus capable of operating many parts of the character has been demanded. As one example, a tank displayed on the teleview is moved in a multiple direction to turn a turret. In this case, two switch opening and closing apparatuses can be provided to settle the problem, but there involves a problem in that the operation is complicated and the cost of fabrication of the entire apparatus is high.

OBJECT OF THE INVENTION

It is a principal object of this invention to provide a multiobjective switch opening and closing apparatus which is simple in construction and in which many switches can be opened and closed by a single operating lever.

It is a further object of this invention to provide a multiobjective switch opening and closing apparatus which is sized so that the apparatus may be mounted on a casing of an existing television game machine without requiring any change in design.

It is another object of this invention to provide a multiobjective switch opening and closing apparatus in which a number of switches are all fixed, and lead wires are not moved during the operation of an operating lever.

Other objects and features of this invention will be apparent from the ensuing description of the embodiments shown in the drawings.

DETAILED DESCRIPTION OF THE PREFERRED EMBODIMENTS

Figure 1:
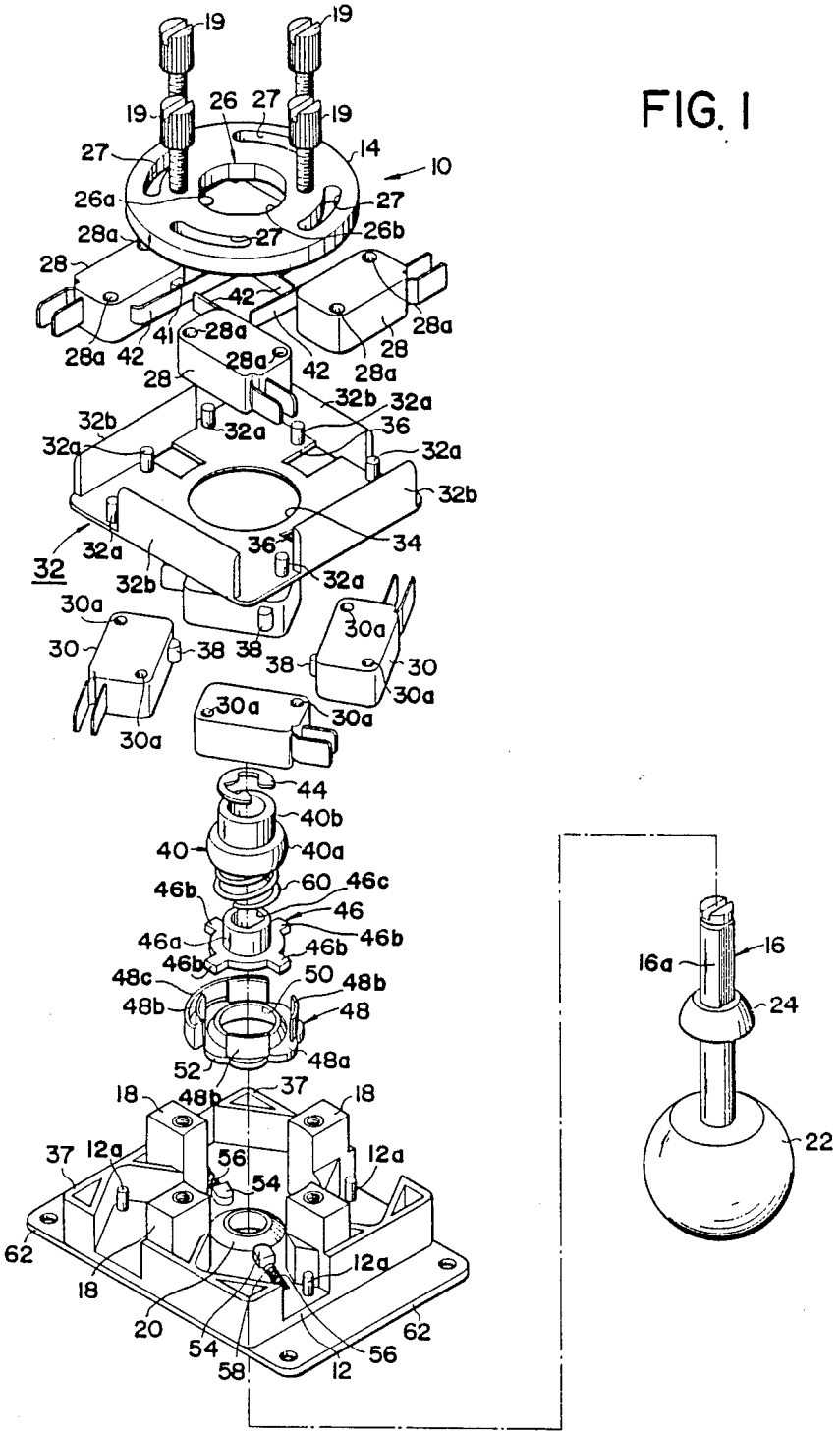
FIG. 1 is an exploded perspective view of a multiobjective switch opening and closing apparatus according to this invention.

In the drawings and in FIGS. 1 to 3 and FIG. 6, a switch assembly 10 according to the present invention comprises a support plate 12, a guide plate 14, a plurality of first automatic-return switches 28, a plurality of second automatic-return switches 30, and an operative lever 16 supported pivotably and rotatably on the support plate 12.

The support plate 12 having a rectangular shape as a whole has a plurality of columnar spacers 18 approximately in a central portion in the extending direction of edges thereof. The guide plate 14 having a disk-like shape as a whole is arranged in contact with the end of the spacers 18 and secured to the spacers 18 through a plurality of screw members 19 whereby the guide plate 14 is maintained parallel to the support plate 12. The dimension of a height of the spacer, that is, the distance between the support plate 12 and the guide plate 14 is set to substantially the same as in a conventional switch assembly.

The support plate 12 has a socket portion 20 in the central portion thereof. The operating lever 16 has one end of a small diameter extending via the socket portion 20 and the other end of a large diameter to which is secured a gripping ball 22. A ball 24 is mounted to one end of the operating lever 16, the ball being received in the socket portion 20 and spherical-paired with the socket portion. The operating lever 16 receives a force of a spring member described later from the other end toward one end thereof. Thereby, the operating lever 16 can be pivotally moved and can be rotated around the axis thereof.

The tube member 40 has a small diameter portion 40*b* extending via a guide hole 26 formed in the central portion of the guide plate 14. The guide hole 26 restricts the pivotal direction and pivotal distance of the operating lever 16. The illustrated guide hole 26 has a hole edge portion comprising a straight line portion 26*a* comprising a part of each side of a square and a circular arc portion 26*b* continuous to a pair of straight line portions 26*a* adjacent to each other. The guide plate 14 has a hole 27 through which a screw member 19 is inserted. The hole 27 extends concentric with a peripheral edge of the guide plate 14 between a line connecting intermediate points of the pair of straight line portions 26*a*, respectively, opposed to each other and a line connecting intermediate points of the pair of circular arc portions 26*b*, respectively, opposed to each other.

The plurality (four in the illustrated embodiment) of first automatic-return switches 28 and the plurality (four in the illustrated embodiment) of second automatic-return switches 30 are arranged in a two-stage fashion between the support plate 12 and the guide plate 14. The switches shown comprise microswitches having a shape of a rectangular parallelopiped as a whole. Each switch has a pair of terminals electrically connected to the body of a television game machine through a lead wire.

The first switches 28 are arranged on a mounting plate 32 having a rectangular shape as a whole arranged between and parallel to the support plate 12 and the guide plate 14 so as to surround the operating lever 16. In the illustrated embodiment, each switch 28 is positioned at a corner portion of a mounting plate 32, the pair of switches 28 adjacent to each other are formed at a right angle to the other, and each switch 28 is at a right angle to the edge of the mounting plate 32.

The mounting plate 32 has a pair of projections 32*a* for locating each first switch 28 to said corner portion and for preventing a movement of each switch 28 in a lateral direction, said projections being fitted in a pair of holes 28*a* provided on each switch. The mounting plate 32 has a protective wall 32*b* of the switch 28 extending along the edge.

The mounting plate 32 has a central hole 34 through which the operating lever 16 extends and having a size in which said lever may be pivotally moved and a square hole 36 extending via the spacer 18. On the other hand, the support plate 12 has a wall 37 having substantially the same height dimension as that of the second switch 30 in order to hold and locate and protect the second switch 30. The mounting plate 32 is in contact with the end in a height direction of each wall 37 of the support plate. The first switch 28 and the mounting plate 32 are prevented from being moved in the axial direction of the operating lever 16 by the guide plate 14. It is noted that the mounting plate 32 can be formed integral with the wall 37.

Figure 4:
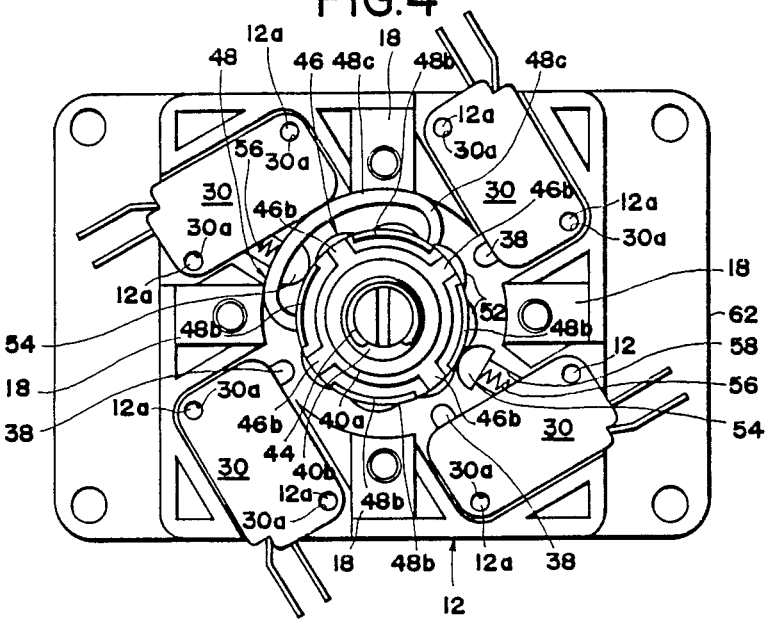
FIGS. 4 and 5 are respective plan and side views of a multiobjective switch opening and closing apparatus with a guide plate, a first switch and a mounting plate removed.
Figure 5:
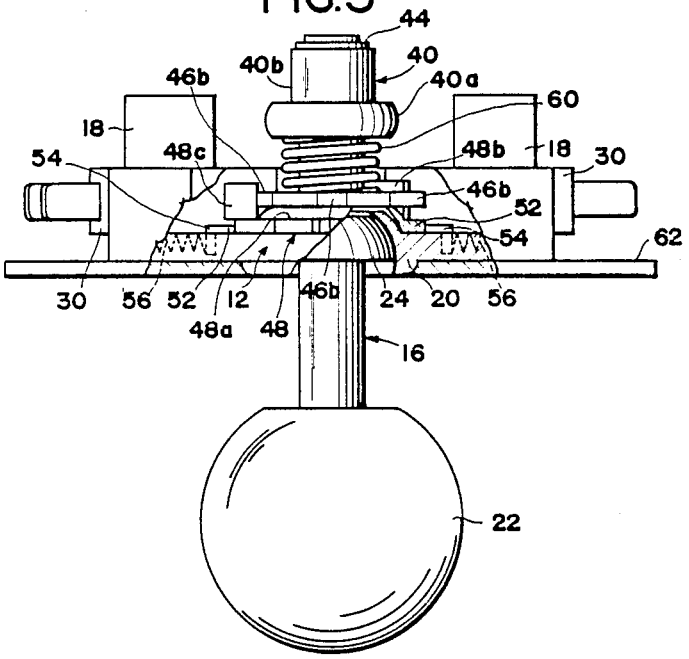
Figure 6:
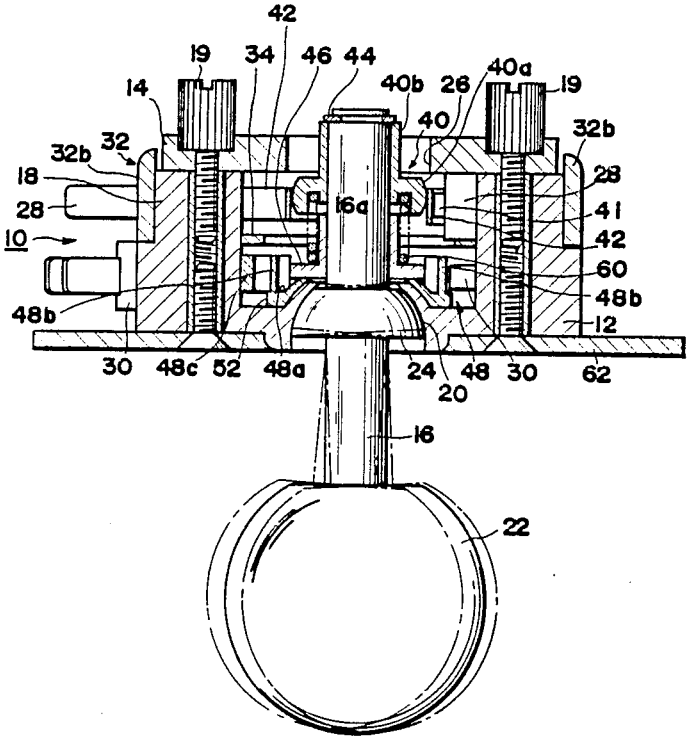
FIG. 6 is a sectional view taken on line 6—6 of FIG. 2.
Figure 7:
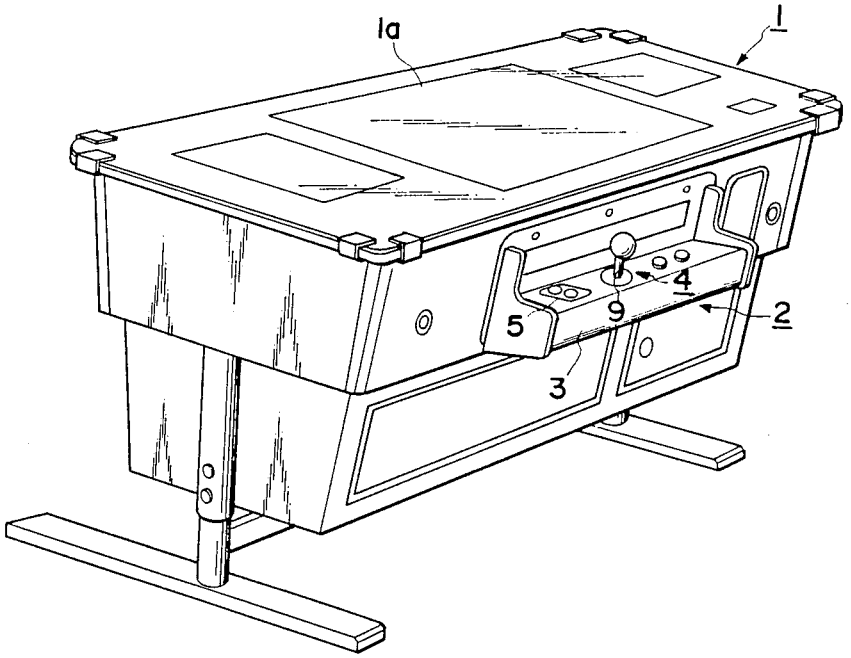
FIG. 7 (PRIOR ART)
FIG. 7 is a perspective view of a television game machine.
Figure 8:
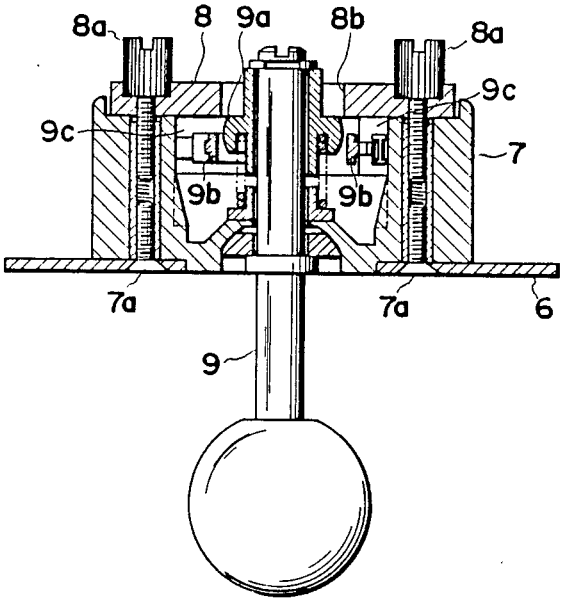
FIG. 8 (PRIOR ART)
FIG. 8 is a sectional view of a conventional switch opening and closing apparatus.

As shown FIG. 4 to FIG. 5, the second switch 30 is arranged and held on the support plate 12 so as to surround the operating lever 16. In the illustrated embodiment, each switch is positioned in the vicinity of each corner, and a pair of switches 30 adjacent to each other are at right angles with respect to each other. Each switch 30 is at a non-right angle, (namely an oblique angle) with respect to each edge of the support plate 12 so that a push button 38 thereof is directed at the center of the socket 20 as shown in FIG. 4. The mounting plate 32 is provided with a pair of projections (not shown) to prevent the second switch from being moved in a lateral direction, said projection being fitted in a pair of holes 30*a* provided in each switch 30.

The first switches 28 are operated by receiving a pivotal force of the operating lever 16 to be pivotally moved. The pivotal force of the operating lever 16 applied by the pivotal operation of the grip ball 22 can be transmitted to a push button 41 of each first switch 28 through a pivotal force transmission means comprising a tube member 40 fitted into said one end of the operating lever 16 and an actuator 42 provided on the first switch 28.

The tube member 40 comprises a large diameter portion 40*a* which can be contacted with the actuator 42 and the small diameter portion 40*b* which can be contacted with the edge of the guide hole 26 of the guide plate, the tube member being prevented from being slipped out of the operating lever by an E ring 44 mounted to the end of said one end of the operating lever 16.

Figure 2:
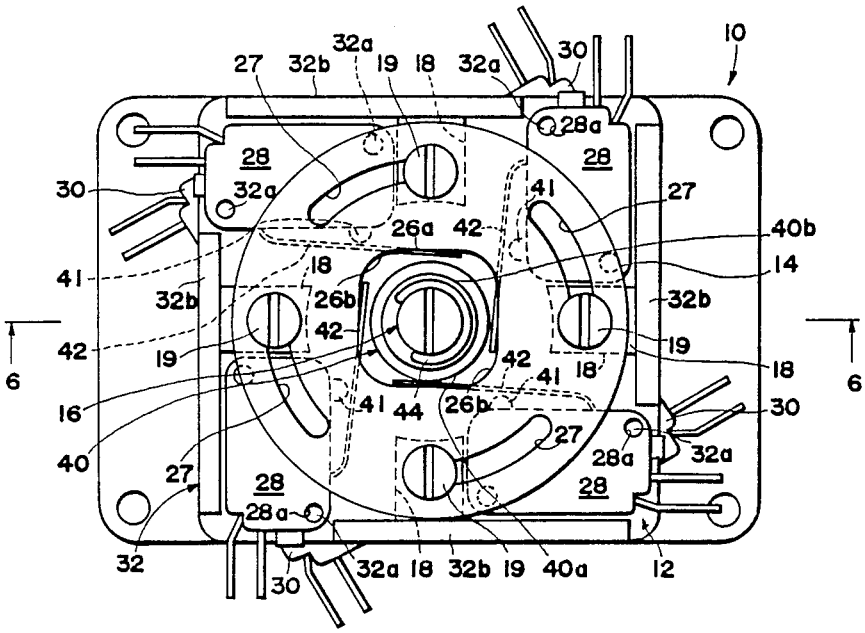
FIG. 2 is a plan view of a multiobjective switch opening and closing apparatus.
Figure 3:
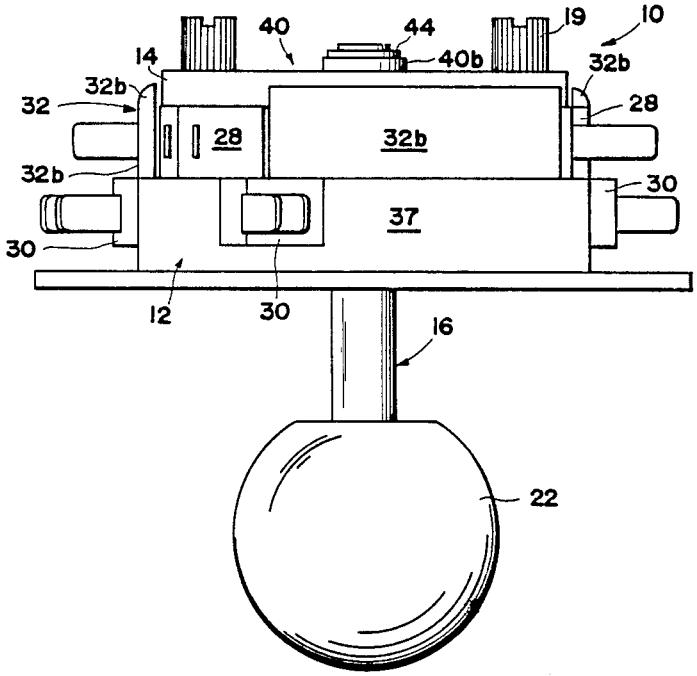
FIG. 3 is an elevation view of a multiobjective switch opening and closing apparatus.

By untightening the screw member 19 to rotate the guide plate 14 through 45°, the guide plate 14 can be displaced from the state shown in FIG. 2 in which the intermediate point of each pair of circular arc portions 26*b* opposed to each other of the guide hole 26 is positioned on the diagonal line of the support plate 12 to the state in which the intermediate point of each pair of straight line portions 26*a*. Thereby, it is possible to vary the distance wherein the operating lever 16 may be pivotally moved.

In the state shown in FIG. 2, when the operating lever 16 is pivotally moved till the small diameter portion 40*b* of the tube member comes into contact with the circular arc portion 26*b* of the guide hole, the large diameter portion 40*a* of the tube member comes into contact with the pair of actuators 42 in the vicinity of the circular arc portion to simultaneously press them. Thereby, a pair of push buttons 41 are simultaneously pressed to simultaneously operate the pair of first switches 28 adjacent to each other. When the small diameter portion 40*b* is placed in contact with the straight line portion 26*a* of the guide hole, only one actuator 42 close to the straight line portion 26*a* is pressed to operate only one switch 28. When the guide plate 14 is in a position displaced, only when the small diameter portion 40*b* comes into contact with the circular arc portion 40*b* of the guide hole, one actuator 42 close to the circular arc portion 40*b* is pressed to operate the switch 28. In this manner, the first switches 28 are selectively operated. In the case where the pair of switches 28 are not required to be operated simultaneously, the actuators 42 need not be provided. In place of the guide plate shown, a guide plate having a guide hole extending crosswise, a guide hole extending in a straight line fashion and the like can be used. Furthermore, in place of the guide plate in the form of a disk, a rectangular plate or the other shapes may be used.

The second switch 30 is operated by receiving a turning force of the operating lever 16 to be rotated. The turning force of the operating lever 16 can be transmitted to the push button 38 of the second switch 30 through the transmission means.

The turning force transmission means comprises a turning force transmission member 46 comprising a tube portion 46*a* fitted into said one end of the operating lever 16 and a plurality of flange portions 46*b* continuous to said tube portion, said member being positioned between a bearing 24 and a tube member 40, and a rotating member 48 fitted into the operating lever 16 rotatably around the axis thereof. The shaped section 16*a* of said one end of the operating lever 16 is non-circular so as not to produce a rotational motion between the tube portion 46*b* of the turning force transmission member and the operating lever 16, and the tube portion 46*a* has an opening 46*c* having a sectional shape in coincidence with said one end 16*a* of lever 16. The rotating member 48 has a disk portion 48*a* formed with an inserting hole 50 for said one end of the operating lever 16, a plurality of stoppers **48*b* comprising a plurality of walls spaced apart in a peripheral direction of the disk portion, and a circular pressing portion 48*c* continuous to a pair of stoppers 48*b* adjacent to each other. The flange portion 46*b* of the turning force transmission member is positioned between the stoppers 48*b* of the rotating member 48. Accordingly, the turning force of the operating lever 16 is transmitted from the flange portion 46*b* to the rotating member 48 via the stopper 48*b* in engagement with the flange portion. The peripheral spacing between the stoppers 48*b* is larger than the peripheral length of the flange portion 46*b* of the turning force transmission member 46 so that the pivotal movement of the operating lever 16 toward various portions of the peripheral edge of the guide hole 26 may be made. When the rotating member 48 is rotated, the pressing portion 48*c* comes into contact with the push buttons 38, one after another so that the pressing portion 48*c* may simultaneously contact the push buttons 38 of a pair of switches 30 which are adjacent to each other. Thus, by rotating the operating lever 16, one or two switches 30 may be selectively operated. In the case where two switches need not be operated simultaneously, the dimension of the length of the pressing portion 48*c* can be set to the dimension of length in which the pressing portion does not contact with the push buttons of the pair of switches 30** simultaneously.

As shown FIG. 1 and FIG. 4, a plurality of circular arc surfaces 52 which are continuous in a wavy form are provide in the peripheral surface of a disk portion **48*a* so that the rotating member 48 may be rotated stepwise. An engaging member 54 which is slidable on the circular arc surface 52 and engageable between the circular arc surfaces 52 and a coil spring 56 for applying a spring force to the engaging member toward the circular arc surface 52 are arranged in a pair of grooves 58 formed in the support plate 12**.

A coil spring 60 to be compressed surrounding the operating lever 16 is arranged between the tube member 40 and the turning force transmission member 48. This coil spring 60 urges the operating lever 16 so that the axis of the operating lever 16 passes through the center of the guide hole 26, and presses the turning force transmission member 48 against the rotating member 48.

The switch assembly 10 is mounted on the casing which forms a part of the control unit of the television game machine through a plate 62 secured to the support plate 12, and the grip ball 22 and said other end of the operating lever 16 are exposed externally of the casing.

According to the present invention, the distance between the support plate on which said first and second switches are arranged and the guide plate is the distance capable of securing the pivotal movement of the operating lever required for operating the first switches, said distance being substantially the same as that of the conventional switch assembly. Thereby, the dimensionn of length of the switch assembly in the axial direction of the operating lever can be made substantially the same as that having no said second switch. Therefore, in changing the content of the television game into further complicated content, the switch assembly according to the present invention can be mounted on the casing of the control unit forming a part of the television game machine after the switch assembly mounted on the existing casing has been removed, without changing the large dimension of the casing of the control unit.

Moreover, according to the present invention, the second switches are of the automatic-return type, and since the switches are actuated by receiving the turning force of the operating lever, the switches can be secured to the support plate. Therefore, even by the pivotal motion or rotational motion of the operating lever, no relative motion between the second switch and the lead wire extending therefrom does not occur, and accordingly, no breaking in wire occurs.

What is claimed is:

1. A multiobjective switch opening and closing apparatus comprising:

a support plate having a socket portion;

an operating lever pivotably and rotatably mounted on said socket portion, said operating lever having a gripping ball at one end portion thereof and a tube member at an opposite end portion thereof, said tube member having a small diameter portion and a large diameter portion;

a mounting plate fixed to said support plate;

a plurality of automatic-return first switches each having an actuator and each mounted on said mounting plate and spaced around said operating lever;

a plurality of automatic-return second switches each having an actuator and each mounted to said support plate and spaced around said operating lever, said mounting plate being positioned on said second switches;

a guide plate with guide hole arranged parallel to said support plate and mounted on said support plate upon said first switches;

a rotating member having a hole therein and rotatably mounted to said socket portion and loosely receiving said operating lever in said hole thereof, said rotating member having a circular pressing portion for pressing said second switches;

a turning force transmission member fixed to said operating lever, said transmission member being loosely engaged with said rotating member; and a coil spring arranged between said tube member and said transmission member, and surrounding said operating lever, whereby when said operating lever is pivotably moved, one or two first switches are operated by said tube member through actuators of said first switches, simultaneously one or two second switches are also operated through said transmission member and said pressing portion of said rotating member by rotating said operating member when said operating lever is rotatably moved, said one or two second switches are operated by said pressing portion of said rotating member through said transmission member, simultaneously said one or two first switches are operated through said tube member by pivoting said operating lever.

2. The multiobjective switch opening and closing apparatus according to claim 1, wherein said mounting plate has a plurality of pairs of projections, said first switches comprising a plurality of microswitches each having actuators and a pair of holes, said first switches being mounted on said mounting plate by tightly inserting respective pairs of projections into respective pairs of holes of said microswitches.

3. The multiobjective switch opening and closing apparatus according to claim 1, wherein said support plate has a plurality of pairs of projections, said second switches comprising a plurality of microswitches each having a pair of holes and mounted on said support plate by tightly inserting said projections into said pairs of hole.

4. The multiobjective switch opening and closing apparatus according to claim 1, wherein said rotating member has a plurality of circular arc surfaces which are continuous in a wavy form, a pair of engaging members slidable mounted on said support plate and contacting said circular arc surfaces, said engaging members being urged in a direction toward said rotating member by a pair of coil springs, whereby said rotating member may be rotated in a stepwise fashion.

5. The multiobjective switch opening and closing apparatus according to claim 1, wherein said support plate has a plurality of columnar spacers approximately in a central portion of said support plate, said mounting plate being mounted on said support plate by inserting said columnar spacers into a plurality of holes of said mounting plate, said guide plate being secured to said spacers by a plurality of screw members.

6. The multiobjective switch opening and closing apparatus according to claim 1, wherein the guide hole of said guide plate has a hole edge portion comprising a straight line portion having a part of each side of a square and a circular arc portion continuous to pairs of straight line portions adjacent each other, and said guide plate has a hole extending along a circle whose center is the center of said guide hole between a line connecting intermediate points of said pair of straight line portions opposed to each other and a line connecting intermediate points of a pair of circular arc portions opposed to each other, said small diameter portion of said tube member being inserted in said guide hole, said guide hole limiting a pivotal range of said operating lever.

* * * * *